United States Patent [19]

Alden

[11] Patent Number: 4,558,659

[45] Date of Patent: Dec. 17, 1985

[54] PARTICLE DISPENSING SYSTEM

[75] Inventor: Jerome S. Alden, Ann Arbor, Mich.

[73] Assignee: Xerox Corporation, Stamford, Conn.

[21] Appl. No.: 411,774

[22] Filed: Aug. 26, 1982

[51] Int. Cl.[4] ..... G03G 15/08

[52] U.S. Cl. ..... 118/653; 118/657; 118/658; 222/DIG. 1; 222/23; 222/232; 355/3 DD

[58] Field of Search ..... 118/657, 653, 658; 222/DIG. 1, 23, 232; 355/3 DD

[56] References Cited

U.S. PATENT DOCUMENTS 4,354,763 10/1982 Koiso et al. ..... 118/658

*Primary Examiner*—Bernard D. Pianalto

*Attorney, Agent, or Firm*—H. Fleischer; J. E. Beck; R. Zibelli

[57] ABSTRACT

An apparatus in which an auger, coupled to a hopper storing toner particles, dispenses toner particles substantially uniformly into a developer mixture. The auger comprises a tubular member having a plurality of apertures therein for discharging toner particles therefrom. A toner transport is disposed interiorly of the tubular member for advancing the toner particles therealong. The toner transport has a helical tooth for advancing the toner particles along the tubular member. The helical tooth has sections thereof deleted therefrom in the region of the apertures in the tubular member to facilitate discharging of the toner particles from the toner member and to prevent caking and clogging thereof.

8 Claims, 3 Drawing Figures

PARTICLE DISPENSING SYSTEM

This invention relates generally to an electrophotographic printing machine, and more particularly concerns an improved particle dispensing apparatus for use in the development system thereof.

Generally, the process of electrophotographic printing includes charging a photoconductive member to a substantially uniform potential to sensitize the surface thereof. The charged portion of the photoconductive surface is exposed to a light image of an origial document being reproduced. This records an electrostatic latent image on the photoconductive member corresponding to the informational areas contained within an original document. After the electrostatic latent image is recorded on the photoconductive member, the latent image is developed by bringing a developer material into contact therewith. This forms a toner powder image on the photoconductive member which is subsequently transferred to a copy sheet. Finally, the powder image is heated to premanently affix it to the copy sheet in image configuration.

A suitable developer material generally comprises carrier granules having toner particles adhering triboelectrically thereto. This two-component mixture is brought into contact with the electrostatic latent image recorded on the photoconductive surface. A portion of the toner particles are attracted from the carrier granules to the latent image. These toner particles adhere to the latent image to form a powder image on the photoconductive surface.

Various methods have been devised for applying developer material to the latent image. For example, the developer material may be cascaded over the latent image with the toner particles being attracted from the carrier granules thereto. Other techniques utilize magnetic field producing devices which form brush-like tufts extending outwardly therefrom into contact with the photoconductive surface. In any event, it is evident that during the development process, toner particles are being continually depleted from the developer material. Thus, additional toner particles must be supplied to the developer material so as to maintain copy density at a substantially optimum level. Typically, a supply of toner particles is stored in a hopper and periodically or continuously dispensed therefrom into the developer material. Numerous types of auger systems have heretofore been utilized for discharging the toner particles into the developer material across the chamber of the development system. However, it has been found that the toner particles frequently cake and clog in the dispensing system. This precludes uniform dispensing and interferes with the homogenous mixing of the newly added toner particles with the developer material. Different approaches have been devised for dispensing toner particles into the developer material. The following disclosures appear to be relevant: U.S. Pat. No. 3,659,556; Patentee: Mutschler; Issued: May 2, 1972; U.S. Pat. No. 4,142,655; Patentee: Fantuzzo; issued: Mar. 6, 1979; Japanese Laid-Open No. 50-29145; Applicant: Canon, Inc.; Application Date: July 11, 1973; IBM Technical Disclosure Bulletin; Line 15, No. 4, September, 1972, Page 1262; By: Queener; Co-pending U.S. Ser. No. 104,255; Applicant: Spehrley, Jr.; Field: Dec. 17, 1979.

The relevant portions of the foregoing disclosures may be briefly summarized as follows:

Mutschler describes a development system in which toner particles are dispensed into a developer mixture. An auger drive system transports developer mixture to a donor roll.

Fantuzzo discloses a pair of flexible augers for transporting toner particles from a remote container to a toner dispenser positioned adjacent the development system.

The Japanese publication describes a toner container having a rotary driven vaned member located in the opening thereof for dispensing particles into a supply passage. A screw conveyor moves the toner particles to the developing unit.

Queener discloses flexible auger for transporting toner particles from a first station to a second station located within an office copying machine.

Spehrley, Jr. discloses a toner particle dispenser having a hopper storing a supply of toner particles therein. An auger is couled to the hopper for receiving the toner particles and uniformly discharging them into the sump of a housing having developer material therein.

In accordance with one aspect of the present invention, there is provided an apparatus for dispensing particles. Means, having at least one region for dispensing particles therefrom, hold the supply of particles therein. Means, operatively associated with the holding means, transport the particles therealong. The transporting means has selected portions thereof contacting the particles to move the particles along the holding means. The selected portions of the transporting means are spaced from the particles in the region of the holding means dispensing the particles therefrom.

Pursuant to another aspect of the present invention, there is provided an apparatus for developing an electrostatic latent image recorded on a photoconductive member used in an electrophotographic printing machine. The apparatus includes means transporting a developer material of carrier granules and toner particles into contact with the electrostatic latent image. A portion of the toner particles are attracted from the carrier granules to the electrostatic latent image forming a toner powder image on the photoconductive member. Means, defining an open ended chamber, store a supply of toner particles therein. Means, having an entrance region therein in communication with the open end of the chamber in the storing means to receive toner particles therefrom, hold a supply of toner particles. The holding means has at least one region for dispensing toner particles therefrom. Means, operatively associated with the holding means, transport the toner particles therealong. The transporting means has selected portions thereof contacting the toner particles to move the toner particles along the holding means. The selected portions of the transporting means are spaced from the toner particles in the region of the holding means dispensing toner particles therefrom.

Other aspects of the present invention will become apparant as the following description proceeds and upon reference to the drawings, in which:

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
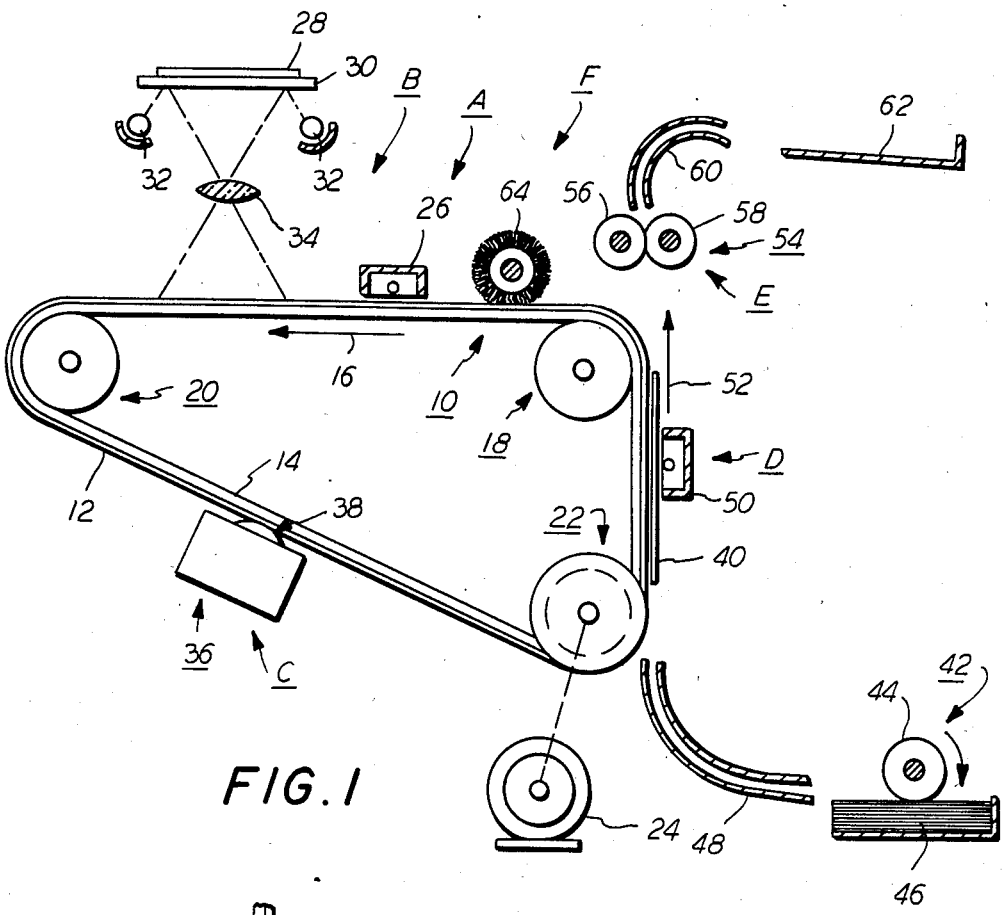
FIG. 1 is a schematic elevational view depicting an illustrative electrophotographic printing machine incorporating the features of the present invention therein.

For a general understanding of the features of the present invention, reference is made to the drawings. In the drawings, like reference numerals have been used throughout to designate identical elements. FIG. 1 schematically depicts the various elements of an illustrative electrophotographic printing machine incorporating the particle dispensing apparatus of the present invention therein. It will become evident from the following discussion that this apparatus is equally well suited for use in a wide variety of electrostatographic printing machines or other types of devices wherein granular particles are being transported from an entrance port to discharge regions and is not necessarily limited in its application to the particular embodiment depicted herein.

Inasmuch as the art of electrophotographic printing is well known, the various processing stations employed in the FIG. 1 printing machine will be shown hereinafter schematically and their operation described briefly with reference thereto.

Turning now to FIG. 1, the electrophotographic printing machine employs a belt 10 having a photoconductive surface 12 deposited on a conductive substrate 14. Preferably, photoconductive surface 12 is made from a selenium alloy with conductive substrate 14 being made from an aluminum alloy which is electrically grounded. Other suitable photoconductive surfaces and conductive substrates may also be employed. Belt 10 moves in the direction of arrow 16 to advance successive portions of photoconductive surface 12 through the various processing stations disposed about the path of movement thereof. As shown, belt 10 is entrained about stripping roller 18, tension roller 20 and drive roller 22. Drive roller 22 is mounted rotatably and in engagement with belt 10. Motor 24 rotates roller 22 to advance belt 10 in the direction of arrow 16. Roller 22 is coupled to motor 24 by a suitable means such as a drive belt. Drive roller 22 includes a pair of opposed, spaced edge guides. The edge gides define a space therebetween which determines the desired path of movement of belt 10. Belt 10 is maintained in tension by a pair of springs (not shown) resiliently urging tension roller 20 against belt 10 with the desired spring force. Both stripper roller 18 and tension roller 20 are mounted rotatably. These rollers are idlers which rotate freely as belt 10 moves in the direction of arrow 16.

With continued reference to FIG. 1, initially a portion of belt 10 passes through charging station A. At charging station A, a corona generating device, indicated generally by the reference numeral 16, charges a portion of photoconductive surface 12 of belt 10 to a relatively high, substantially uniform potential.

Next, the charged portion of photoconductive surface 12 is advanced through exposure station B. At exposure station B, an original document 28 is positioned facedown upon a transparent platen 30. Lamps 32 flash light rays onto original document 28. The light rays reflected from originl document 28 are transmitted through lens 34 forming a light image thereof. Lens 34 focuses the light image onto the charged portion of photoconductive surface 12 to selectively dissipate the charge thereon. This records an electrostatic latent image on photoconductive surface 12 which corresponds to the informational area contained within original document 28 disposed upon transparent platen 30. Thereafter, belt 10 advances the electrostatic latent image recorded on photoconductive surface 12 to development station C.

At development station C, a magnetic brush development system, indicated generally by the reference numeral 36, transports a developer mixture of carrier granules and toner particles into contact with the electrostatic latent image recorded on photoconductive surface 12. Magnetic brush development system 36 includes a magnetic brush developer roller 38. Magnetic brush developer roller 38 forms a brush of carrier granules and toner particles. The toner particles are attracted from the carrier granules to the electrostatic latent image forming a toner powder image on photoconductive surface 12 of belt 10. The detailed structure of magnetic brush development system 36 will be described hereinafter with reference to FIG. 2.

After development, belt 10 advances the toner powder image to transfer station D. At transfer station D, a sheet of support material 40 is moved into contact with the toner powder image. Support material 40 is advanced to transfer station D by a sheet feeding apparatus, indicated generally by the reference numerals 42. Preferably, sheet feeding apparatus 42 includes a feed roll 44 contacting the uppermost sheet of a stack of sheets 46. Feed roll 44 rotates to advance the uppermost sheet from stack 46 into chute 48. Chute 48 directs the advancing sheet of support material 40 into contact with photoconductive surface 12 of belt 10 in a timed sequence so that the toner powder image developed thereon contacts the advancing sheet of support material at transfer station D.

Transfer station D includes a corona generating device 50 which sprays ions onto the back side of sheet 40. This attracts the toner powder image from photoconductive surface 12 to sheet 40. After transfer, the sheet continues to move in the direction of arrow 52 onto a conveyor (not shown) which advances the sheet to fusing station E.

Fusing station E includes a fuser assembly, indicated generally by the reference numeral 54, which permanently affixes the transferred powder image to sheet 40. Preferably, fuser assembly 54 includes a heated fuser roller 56 and a back-up roller 58. Sheet 40 passes between fuser roller 56 and back-up roller 58 with the toner powder image contacting fuser roller 56. In this manner, the toner powder image is permanently affixed to sheet 40. After fusing, chute 60 guides the advancing sheet to catch tray 62 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a pre-clean corona generating device (not shown) and a rotatably mounted fibrous brush 64 in contact with photoconductive surface 12. The pre-clean corona generator neutralizes the charge attracting the particles to the photoconductive surface. These particles are cleaned from photoconductive surface 12 by the rotation of brush 64 in contact therewith. Subsequent to cleaning, a discharge lamp (not shown) floods photoconductive surface 12 with light to dissipate any residual charge remaining thereon prior to the charging thereof for the next successive imaging cycle.

It is believed that the foregoing description is sufficient for purposes of the present application to illustrate the general operation of an exemplary electrophotographic printing machine incorporating the features of the present invention therein.

Figure 2:
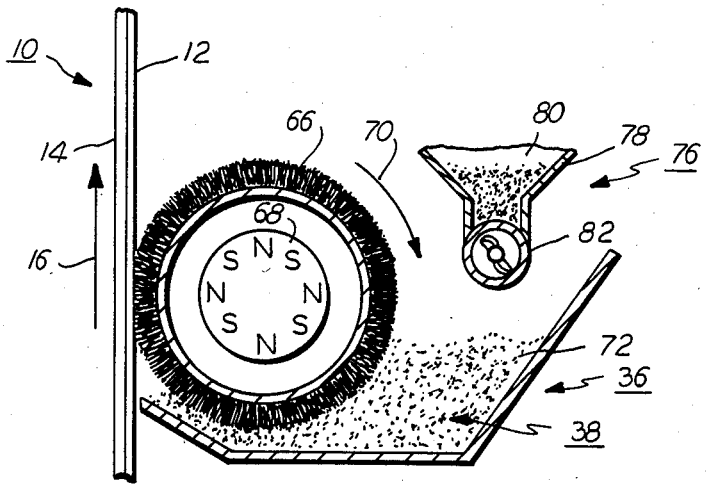
FIG. 2 is a schematic elevational view showing a development system used in the FIG. 1 printing machine.

Referring now to FIG. 2, there is shown development system 36 in greater detail. As depicted thereat, development system 36 includes a developer roller 38 having a non-magnetic tubular member 66. An elongated magnetic member 68 is positioned interiorly of tubular member 66 and spaced from the interior peripheral surface thereof. Tubular member 66 rotates in the direction of arrow 70 so as to advance the developer material into contact with the electrostatic latent image recorded on the photoconductive surface of belt 10. As tubular member 66 rotates in the direction of arrow 70, it passes through the sump of chamber 72 and housing 74. Developer material, disposed in chamber 72, is attracted to tubular member 66 via the magnetic field generated by elongated magnetic member 68. In this manner, the developer material is attracted to tubular member 68 and advances therewith into contact with the electrostatic latent image recorded on photoconductive surface 12 of belt 10. The electrostatic latent image attracts the toner particles from the developer material. Thus, toner particles are being continually depleted from the developer material. If additional toner particles were not furnished to the developer material, the copies would eventually become progressively lighter degradating in quality. To avoid the foregoing, a toner particle dispenser, indicated generally by the reference numeral 76, furnishes additional toner particles to chamber 72 of housing 74. Toner particle dispenser 76 includes a hopper 78 storing a supply of toner particles in chamber 80 thereof. Hopper 78 is open ended with the open end being in communication with the entrance port of auger 82. Auger 82 includes a tubular member having a plurality of apertures therein and a helical member. As the helical member rotates, it advances the toner particles from hopper 80 along the tube thereof. The toner particles move along the tube and are dispensed through the apertures therein. The detailed structure of toner dispenser 76 will be described hereinafter with reference to FIG. 3.

By way of example, elongated magnetic member 68 is cylindrical and preferably made from barium ferrite having a plurality of magnetic poles impressed about the circumferential surface thereof. Tubular member 66 is made preferably from aluminum having the exterior circumferential surface thereof roughened.

Figure 3:
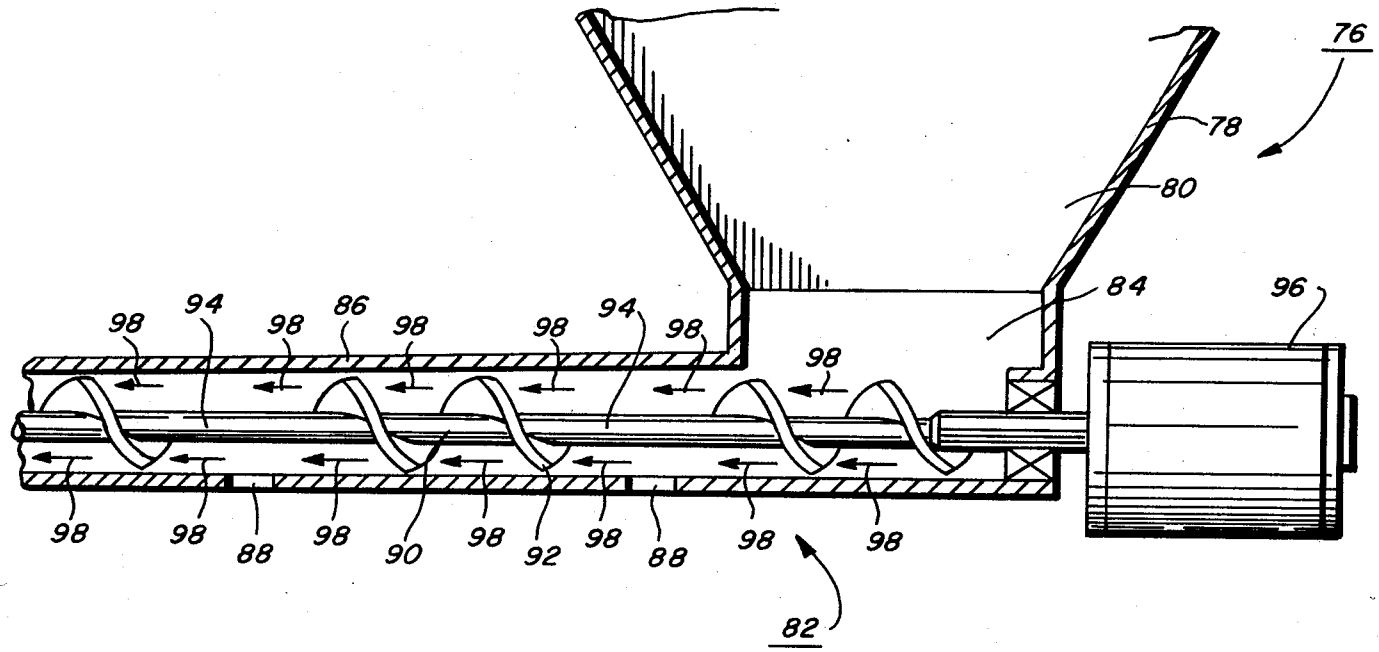
FIG. 3 is a schematic elevational view illustrating the toner particle dispensing system used in the FIG. 2 development system.

Referring now to FIG. 3, toner particles in chamber 80 of hopper 78 descend into entrance port 84 of auger 82. Auger 82 includes a tubular member 86 extending across chamber 72 (FIG. 2) of housing 74 (FIG. 2). In this way, toner particles are substantially uniformly discharged across chamber 72 of housing 74. This facilitates the mixing of the toner particles with the denuded carrier granules. Tubular member 86 includes a plurality of substantially equally spaced apertures 88 therein. An elongated shaft 90 is disposed interiorly of tubular member 86. Shaft 90 has a plurality of sets of spirally wound protuberances or teeth 92 extending outwardly therefrom. Adjacent sets of protuberances 92 have a region interposed therebetween wherein a tooth is missing therefrom. Thus, there is a gap or space on shaft 90 having no teeth thereon. This gap, designated generally by the reference numeral 94, is positioned adjacent the apertures 88 in tubular member 86. Preferably, each set of protuberances 92 is continuous and helically configured. Thus, adjacent sets of proturberances 92 are spaced from one another by a gap 94 located in the region of the apertures 88 in tubular member 86. Motor 96 is coupled to shaft 90. Actuation of motor 96 rotates shaft 90 which, in turn, causes rotation of the sets of protuberances 92 integral therewith. As protuberances 92 rotate, the toner particles are advanced from entrance port 84 in the direction of arrows 98 to the dispensing regions, i.e. apertures 88. In the region of apertures 88, a localized area of high toner particle concentration and internal force is produced. This promotes dispensing or discharge of the toner particles through apertures 88. Furthermore, caking and clogging of the toner particles is prevented insuring substantially uniform discharge of the toner particles from tubular member 86. Preferably, the gap 94, i.e. the region between adjacent set of protuberances 92, is from $1\frac{1}{2}$ to 1 pitches in length and corresponds essentially to a single tooth or protuberance.

While the present invention has been described as being employed in a toner particle dispensing system, one skilled in the art will appreciate that it may be utilized in any system for moving and dispensing granular particles substantially uniformly.

In recapitulation, it is clear that the dispensing apparatus of the present invention includes a hopper storing a supply of toner particles therein and an auger having selected portions thereof void of teeth in the region adjacent the dispensing apertures. This provides for the uniform dispensing of the toner particles without caking and clogging thereof. In this way, precise quantities of toner particles are metered from the apertures substantially uniformly across the developer housing.

It is, therefore, evident that there has been provided, in accordance with the present invention, an apparatus for advancing particles from an entrance port to a plurality of discharging apertures. This apparatus fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for dispensing particles, including:

a substantially tubular member having an entrance port for receiving particles and a plurality of apertures therein for dispensing particles therefrom; and means, operatively associated with said tubular member, for transporting the particles therealong, said transporting means comprising a plurality of sets of protuberances with each of said sets of protuberances being spaced from one another in the region of the apertures in said tubular member so that the particles are dispensed substantially uniformly from the apertures in said tubular member with clogging and caking of the particles being substantially prevented.

2. An apparatus according to claim 1, wherein said transporting means includes an elongated member having said sets of protuberances extending outwardly therefrom with each of said sets of protuberances being continuous.

3. An apparatus according to claim 2, wherein each of said sets of protuberances extends in a spiral configuration.

4. An apparatus according to claim 3, wherein each of said sets of protuberances extends in a helical configuration.

5. An apparatus for developing an electrostatic latent image recorded on a photoconductive member used in an electrophotographic printing machine, including:

means for transporting a developer material of carrier granules and toner particles into contact with the electrostatic latent image so that a portion of the toner particles are attracted from the carrier granules to the electrostatic latent image forming a toner powder image on the photoconductive member;

means, defining an open ended chamber, for storing a supply of toner particles therein;

a tubular member having an entrance port therein in communication with the open end of the chamber in said storing means to receive toner particles therefrom and a plurality of apertures therein for dispensing toner particles therefrom; and means, operatively associated with said tubular member, for transporting the toner particles therealong, said transporting means comprising a plurality of sets of protuberances with each of said sets of protuberances being spaced from one another in the region of the apertures in said tubular member so that the toner particles are dispensed substantially uniformly from the apertures in said tubular member with clogging and caking of the toner particles being substantially prevented.

6. An apparatus according to claim 5, wherein said transporting means includes an elongated member having said sets of protuberances extending outwardly therefrom with each of said sets of protuberances being continuous.

7. An apparatus according to claim 6, wherein each of said sets of protuberances extends in a spiral configuration.

8. An apparatus according to claim 7, wherein each of said sets of protuberances extends in a helical configuration.

* * * * *